US005324906A

United States Patent [19]

Dong

[11] Patent Number: 5,324,906

[45] Date of Patent: Jun. 28, 1994

[54] METHOD FOR CONTROLLING A HEATING OF HIGH FREQUENCY COOKER AND APPARATUS THEREOF

[75] Inventor: Eun S. Dong, Seoul, Rep. of Korea

[73] Assignee: Goldstar Co., Ltd., Seoul, Rep. of Korea

[21] Appl. No.: 993,554

[22] Filed: Dec. 21, 1992

[30] Foreign Application Priority Data

Dec. 21, 1991 [KR] Rep. of Korea ..... 1991-23277

[51] Int. Cl.[5] ..... H05B 6/12

[52] U.S. Cl. ..... 219/626; 99/325; 219/667

[58] Field of Search ..... 219/10.493, 10.77, 10.55 B, 219/10.55 E, 506; 426/523, 233; 99/325, DIG. 14, 451

[56] References Cited

U.S. PATENT DOCUMENTS 4,045,640 8/1977 McQueen, Jr. et al. ..... 219/10.55 B
4,130,749 12/1978 Tanaka et al. ..... 219/10.55 B
4,870,238 9/1989 Hodgetts et al. ..... 219/10.55 B
4,952,766 8/1990 McDonald ..... 219/10.55 B
5,096,725 3/1992 Kim ..... 426/233

*Primary Examiner*—Philip H. Leung
*Attorney, Agent, or Firm*—Morgan & Finnegan

[57] ABSTRACT

A high frequency cooker which detects a sound generated upon boiling of a material to be heated in response to the material being heated and switch as to a cooking mode in response to the detected signal of that sound. The cooker comprises a heating section for heating a material to be heated, a sensor for detecting a sound generated from the material to be heated upon boiling of the material to be heated, and a control section for controlling the heating section in response to the detected sound. The cooker can sense the sound of the material to be heated and can switch automatically from a cooking mode to a warm mode even by only making a single function selection. An optimum cooking state of the food can be maintained, and unnecessary power loss can also be prevented.

2 Claims, 2 Drawing Sheets

METHOD FOR CONTROLLING A HEATING OF HIGH FREQUENCY COOKER AND APPARATUS THEREOF

FIELD OF THE INVENTION

The present invention relates to a high frequency cooker, and more particularly to a method for controlling a heating of high frequency cooker and apparatus thereof which is made to detect a sound generated from a heated material in response to a material to be heated becoming heated.

BACKGROUND OF THE INVENTION

High frequency cookers mounted with a system for automatically sensing a completion of heating of a material to be heated are made to be utilized in various forms. As a sensing device used for a high frequency cooker, there are a humidity sensor for detecting a change of humidity, and a temperature sensor for detecting a change of temperature. The humidity sensor detects a change of electric resistance of an element in accordance with a water molecule adhered on the element surface, and the temperature sensor detects a temperature to be changed in response to a heated state of a material to be heated, and a heating source is controlled in accordance with the detected humidity or temperature.

However, in case of utilizing the humidity sensor, sensitivity is decreased by contamination of the element surface. Since contamination of the element surface should be periodically burnt out in order to prevent such sensitivity deterioration and in order to maintain a stable capacity, a complicated structure and operation are required. Additionally, a thermister for a temperature sensor is an expensive part. A thermister should be used in case of utilizing a temperature sensor and, hence the price of the product becomes increased. Furthermore, heating becomes uneven because a temperature error in case of actual cooking in accordance with the fixing position of thermister and distance to the heating source.

SUMMARY OF THE INVENTION

Therefore, the present invention is directed to solve these problems. It is an object of the present invention to provide a method for controlling the heating of a high frequency cooker which is made to detect a boiling sound generated during cooking a material to be heated and to so control a heating source of the material to be heated.

Another object of the present invention is to provide a high frequency cooker which is made to control a heating source of a material to be heated by using a sound sensor.

In order to accomplish these objects, a feature of the present invention is a method for controlling a high frequency cooker having a sound sensor said process comprising the steps of:

heating a material to be heated;

sensing a boiling sound generated when a material to be heated boils;

providing a control signal to a control means when said boiling sound is sensed to more than a predetermined magnitude for more than a predetermined time; and controlling heating of said material to be heated in accordance with said control signal.

Another feature of the present invention is a high frequency cooker comprising:

a means for sensing a boiling sound generated when the material to be heated boils; and a means for controlling said heating means in accordance with the output of said boiling sound sensing means.

The heating control device of the present invention makes sense the sound generated at the time of cooking a material to be heated whereby switch from a cooking mode to a keep warm mode after a desired time after boiling of a material to be heated so as not to be excessively heated.

BRIEF DESCRIPTION OF THE DRAWINS

FIG. 1 is a block diagram of a high frequency induction heater in accordance with a first preferred embodiment of the present invention, FIG. 2 is a detailed circuit diagram of FIG. 1, and FIG. 3 is a flow chart for illustrating a method for controlling a heating of high frequency induction heater in accordance with the present invention.

DETAILED DESCRIPTION OF THE INVENTION

Hereinafter, a preferred embodiment of the present invention will be described in more detail with reference to the accompanying drawings.

Figure 1:
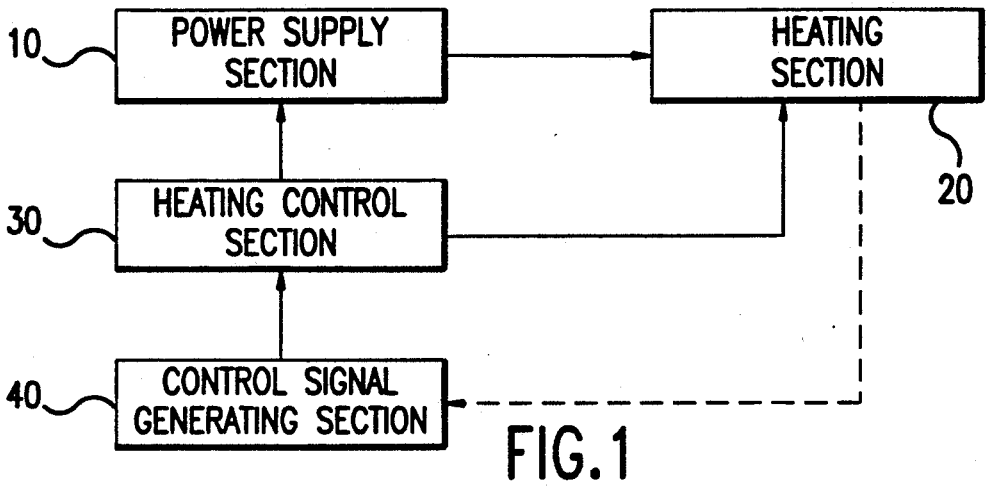
Figure 3:
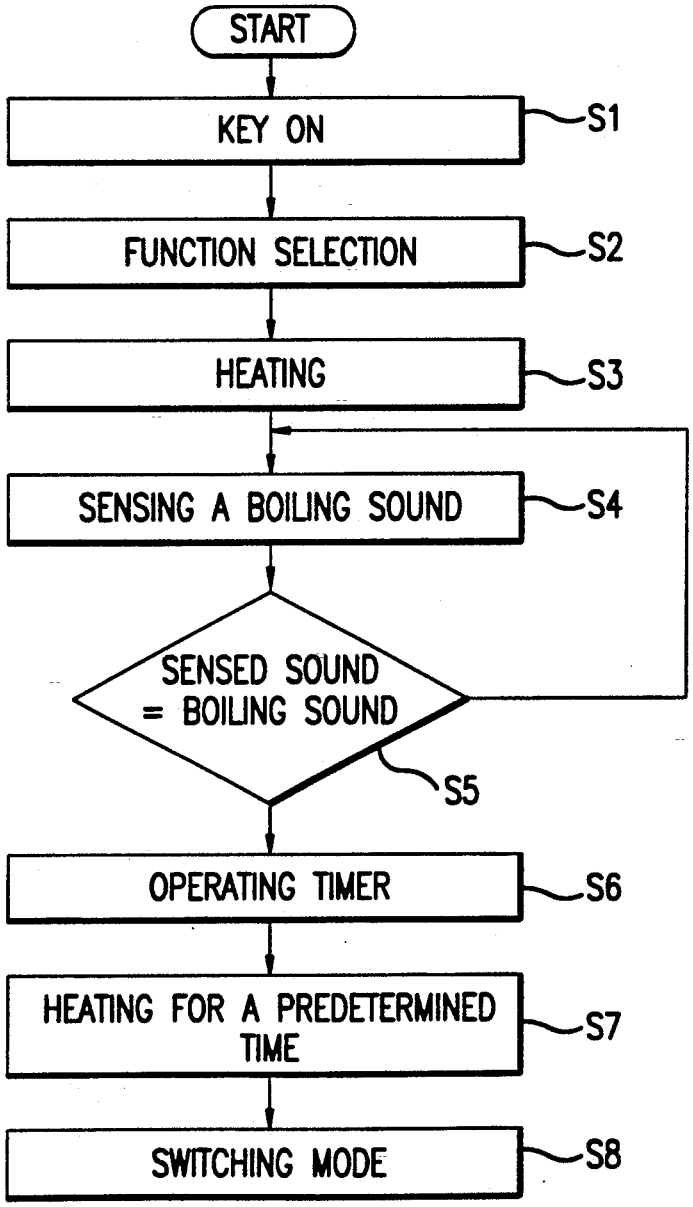

FIG. 1 is a block diagram of the high frequency induction heating cooker in accordance with a first preferred embodiment of the present invention, and which comprises: a power supply section 10, a heating section 20 which is driven by a supplying power of the power supply section 10 and for cooking a material to be heated, a control section 30 for controlling a cooking mode state of the heating section 20, and a control signal generating section 40 for detecting a sound generated from the material to be heated upon cooking the material to be heated which is loaded to the heating section 20.

Figure 2:
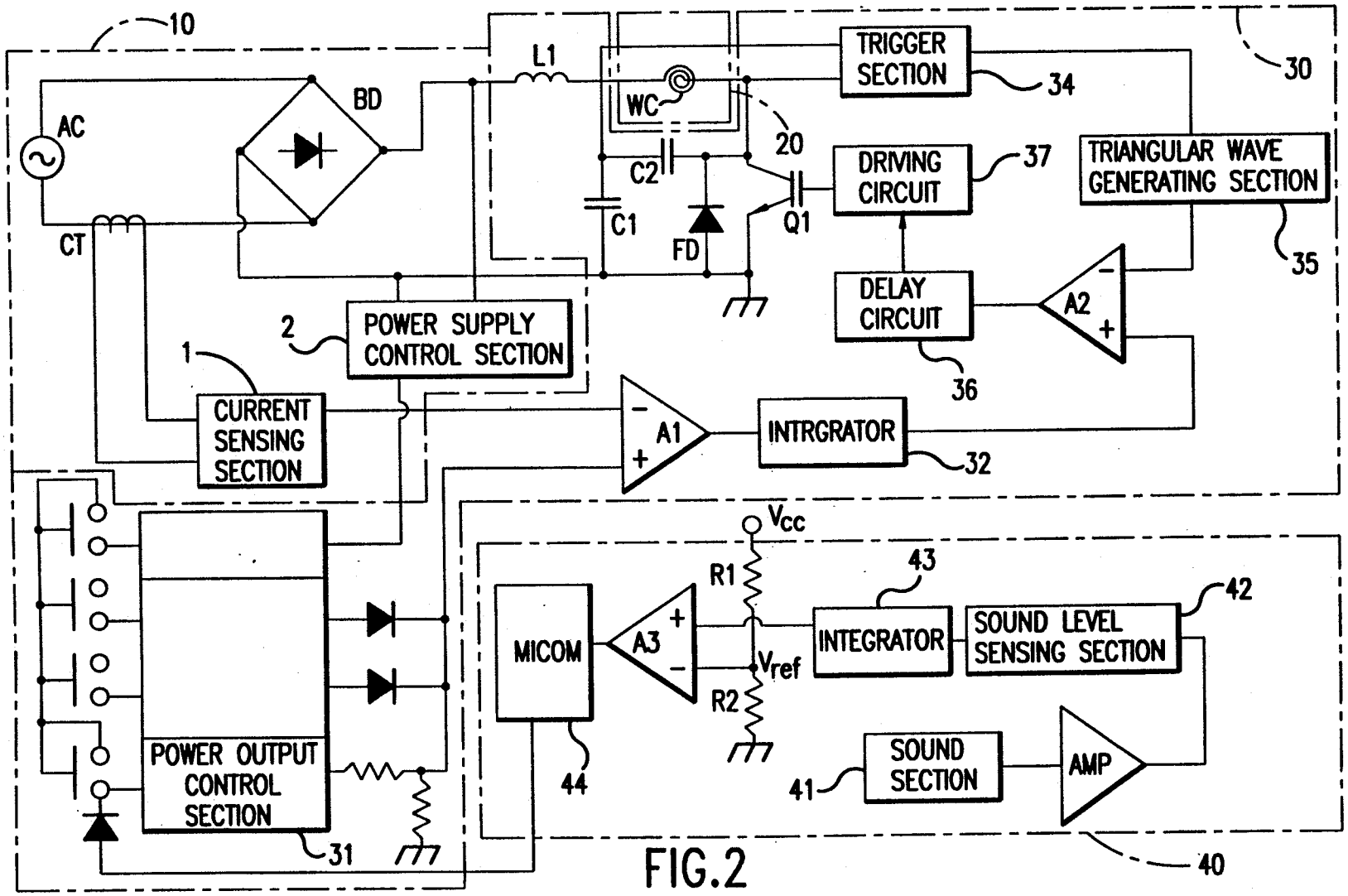

FIG. 2 is a detailed circuit diagram of FIG. 1, in which the power supply section 10 includes a bridge diode BD for rectifying a commercial alternating current power AC to a direct current, a current sensing section 1 for detecting a supplying current of the commercial alternating current power AC through a current transformer CT, and a power supply control section 2 for controlling an output of the bridge diode BD. The heating section 20 consists of a work coil (WC). The heating control section 30 comprises: a comparator A1 for comparing an output of the current sensing section 1 within the power supply section 10 and an output of a power output control section 31, an integrator 32 for integrating an output comparing value of the comparator A1, a tuning circuit 33 which includes an inductor L1 and a capacitor C1 and connected to an output terminal of the bridge diode BD within the power supply section 10 whereby generates a tuning frequency, a trigger section 34 for finding a tuning trigger point by inputting an output of the heating section 20 and a tuning frequency of the tuning circuit 33, a triangular wave generating section 35 for generating a triangular wave in accordance with the output of the trigger section 34, a comparator A2 for comparing an output of the integrator 32 and an output of the triangular wave generating section 35, a delay circuit 36 for delaying during a predetermined time period in accordance with the output of the comparator A2, and a driving circuit 37 for turning on or off a transistor Q1 which switches a driving of the heating section 20 in accordance with the output of the delay circuit 36. Unexplained reference numeral symbol C2 represents a capacitor and a symbol D represents a diode. The power supply section 10, heating section 20, and control section 30 are same construction as a conventional high frequency induction heater.

The control signal generating section 40 of the present invention comprises: a sound generator 41 for detecting a sound generated from a material to be heated which is heated by the heating section 20, an amplifier AMP for amplifying the sound detected at the sound sensor 41, a sound level sensing section 42 for detecting only a sound more than a predetermined magnitude among the output signals of the amplifier AMP, a comparator A3 for comparing a reference voltage Vref divided by resistors R1, R2 and an output of the sound level sensing section 42, and a micom 44 for generating a signal which controls the output control section 31 within the heating control section 30 in accordance with the comparing output signal of the comparator A3.

Operation of the high frequency induction heater cooker in accordance with the first preferred embodiment of the present invention constructed as these will be described in detail below. As described before, the construction of the power supply section 10, heating section 20, and heating control section 30 is same as conventional one, and its operation is also same. Accordingly its detailed description will be omitted.

The sound sensor 41 detects a sound generated upon heating the material to be heated within a container, for example, a sound generated when a soup or a pot stew boils, and the sensed sound signal is amplified through the amplifier AMP. The sound level sensing section 42 detects only a sound more than a predetermined magnitude among the outputting amplified signals of the amplifier AMP. The integrator 43 excludes an intermittent sound level from the output of the sound level sensing section 42 and outputs only that of more than a predetermined sound level continueing for a predetermined time period. The comparator A3 compares the output of the integrator 43 and the reference voltage Vref, and when it is a sound generated at a time of boiling a material to be heated, outputs "high" signal. The micom 44 is applied with "high" signal of the comparator A3 and makes a timer (not shown) to operate whereby maintains a boiling state of the material to be heated for a predetermined time period, and after a predetermined time period is elapsed, switches from a cooking mode to a keep warm mode and thereby makes to be able to execute the keep warm mode.

Explaining by referring the flow chart of FIG. 1, firstly a power "on" key is pressed (step S1), and a function selecting "key" is pressed (step S2) whereby a cooking function is selected in accordance with the material to be heated to cook. According to this, a heating for the material to be heated is started (step S3). A sound of the material to be heated in accordance with the execution of heating, e.g., a boiling sound generated upon boiling is sensed (step S4), whether or not the sensed sound is a sound generated upon boiling, is judged (step S5). When the sensed sound is a sound generated upon boiling, a timer is operated (step S6), and continuous heating is executed for a predetermined time period (step S7) and thereafter, the cooking mode is switched to the keep warm mode so as not to further boil the material to be heated (step S8).

A user can directly confirm the boiling state of the material to be heated and execute above-mentioned function by handling the key, but in order to confirm a state of the material to be heated, the user should be ready to suffer an inconvenience. However, in accordance with the present invention, since the boiling sound of the material to be heated is sensed only by the function selecting of one time whereby the cooking mode can be automatically switched to the keep warm mode, an optimum cooking state of the food can be maintained, and unnecessary power loss can also be prevented.

What is claimed is:

1. A high frequency cooker, comprising:

heating means for heating a material to be heated in a cooking mode, sensing means for sensing a boiling sound generated when said material heated by said heating means boils and for outputting a signal indicating said boiling sound is sensed, and controlling means for controlling said heating means in accordance with the signal received from said sensing means, and for switching said heating means from said cooking mode to a keep warm mode responsive to said signal, wherein said sensing means comprises:

sound sensor means for sensing said boiling sound, sound level sensing means for receiving said boiling sound from said sound sensor means and for sensing and outputting a boiling threshold sound when said boiling sound is more than a first predetermined magnitude, integrator means for integrating said boiling threshold sound received from said sound level sensing means and for outputting an integrated boiling sound, comparator means for receiving said integrated boiling sound from said integrator means, for comparing said integrated boiling sound to a second predetermined magnitude and for outputting a boiling signal when said integrated boiling sound is more than said second predetermined magnitude, and control indicator means for outputting said signal to said controlling means when a predetermined time period has elapsed after said boiling signal is output from said comparator means to additionally heat the material to be heated before said controlling means performs the controlling.

2. A method of controlling a high frequency cooker having a sound sensor, comprising the steps of:

(a) heating a material to be heated in a cooking mode, (b) sensing a boiling sound generated when the material to be heated boils, (c) providing a control signal when said boiling sound is continuously sensed at more than a predetermined magnitude for more than a predetermined time period, and (d) controlling a heating of said material to be heated in accordance with said control signal provided in said providing step (c), and for switching said heating step (a) from the cooking mode to a keep warm mode responsive to the control signal, wherein said sensing step (b) comprises the steps of:

(b1) sensing the boiling sound, (b2) sensing a boiling threshold sound when the boiling sound is more than a first predetermined magnitude, (b3) integrating the boiling threshold sound generating an integrated boiling sound, (b4) comparing the integrated boiling sound to a second predetermined magnitude and generating a boiling signal when the integrated boiling sound is more than the second predetermined magnitude, and (b5) outputting the control signal to said controlling step (d) when a predetermined time period has elapsed after said boiling signal is generated in said comparing step (b4) to additionally heat the material to be heated before said controlling step (d) performs the controlling.

* * * * *